US009352190B2

(12) United States Patent
Frankhauser

(10) Patent No.: US 9,352,190 B2
(45) Date of Patent: May 31, 2016

(54) KNEE ASCENDER ASSEMBLY FOR ROPE CLIMBING

(71) Applicant: Michael Allen Frankhauser, Galloway, OH (US)

(72) Inventor: Michael Allen Frankhauser, Galloway, OH (US)

( * ) Notice: Subject to any disclaimer, the term of this patent is extended or adjusted under 35 U.S.C. 154(b) by 0 days.

(21) Appl. No.: 14/717,535

(22) Filed: May 20, 2015

(65) Prior Publication Data

US 2015/0251057 A1 Sep. 10, 2015

Related U.S. Application Data

(63) Continuation of application No. PCT/US2014/037000, filed on May 6, 2014.

(60) Provisional application No. 61/820,006, filed on May 6, 2013.

(51) Int. Cl.

| | |
|---|---|
| ***A63B 27/02*** | (2006.01) |
| ***A62B 1/14*** | (2006.01) |
| ***A63B 29/02*** | (2006.01) |
| *A62B 35/00* | (2006.01) |

(52) U.S. Cl.

CPC . *A63B 27/02* (2013.01); *A62B 1/14* (2013.01); *A63B 29/02* (2013.01); *A62B 35/00* (2013.01)

(58) Field of Classification Search

CPC ..... A62B 1/14; A62B 35/00; A63B 27/00; A63B 27/02; A63B 29/00; A63B 29/02; A63B 29/08; A63B 2225/09

See application file for complete search history.

(56) References Cited

U.S. PATENT DOCUMENTS

| | | | | | |
|---|---|---|---|---|---|
| 428,812 | A | * | 5/1890 | Johanson | A01M 31/02 182/135 |
| 3,357,520 | A | * | 12/1967 | Foote | A62B 1/14 182/5 |
| 3,814,210 | A | * | 6/1974 | Hoffman | A62B 1/14 182/135 |
| 3,869,021 | A | * | 3/1975 | Sutherland | A62B 35/0018 182/135 |
| 5,234,075 | A | * | 8/1993 | Lowden | A62B 1/14 182/135 |
| 2013/0133981 | A1 | | 5/2013 | Spraggon | |

FOREIGN PATENT DOCUMENTS

| | | |
|---|---|---|
| GB | 2432541 A | 5/2007 |
| RU | 83011 | 5/2009 |
| SU | 298335 A1 | 4/1971 |
| WO | 2010097555 A1 | 9/2010 |
| WO | 2012022943 A1 | 2/2012 |

OTHER PUBLICATIONS

Extended European Search Report for EP 14795422, Mar. 18, 2016.

* cited by examiner

*Primary Examiner* — Colleen M Chavchavadze
(74) *Attorney, Agent, or Firm* — Standley Law Group LLP

(57) ABSTRACT

A secondary ascender system for use in rope climbing and with other rope climbing systems that provides a knee ascender permitting full range of motion and energy capture from two legs by encasing an interior portion of the length of an elastic cord used for tending the knee ascender within a load bearing member. The load bearing member connects a foot attachment to an ascender and transfers loads applied to the foot attachment and via the elastic cord during tending to the ascender to advance up the rope.

20 Claims, 2 Drawing Sheets

KNEE ASCENDER ASSEMBLY FOR ROPE CLIMBING

CROSS-REFERENCE TO RELATED APPLICATIONS

This application is a continuation and claims the benefit of International Application No. PCT/US2014/037000 filed 6 May 2014, which in turn claims priority to U.S. Provisional Application No. 61/820,006 filed 6 May 2013, the contents of each of which being hereby incorporated by reference as if fully recited herein.

TECHNICAL FIELD

Exemplary embodiments of the present invention relate generally to mechanical devices and more specifically to devices used in rope climbing.

BACKGROUND OF THE INVENTION

When climbing a static line, for example a rope secured to a high tree branch, it is common to use one or more ascenders to ease the effort required for climbing. "Ascenders" are generally devices that are threaded or otherwise engaged with a line and enable a climber to move the ascender along the length of the rope in one direction. Attempts to move the ascender in the opposing direction cause the ascender to lock in place, wherein a gripping mechanism operates to prevent movement in that direction, often by the engagement of teeth, ribs or other such protrusions on a cam or other movable surface that may optionally be spring biased. In this manner, ascenders can be advanced along the rope by pushing or pulling, and then bear the partial or full weight of the climber without moving in the opposite direction of travel along the rope. Auto-locking or auto-braking belay devices are also similar devices that allow movement in one direction, and while primarily used to travel down a rope, may sometimes be used in a similar manner to ascend.

It is common for climbers to utilize two ascenders in a climbing system in order to more easily and readily ascend one or more static lines. In those cases, the ascenders typically are advanced in an alternating fashion, with one ascender bearing the weight of the climber while the other ascender is being advanced. In this manner, a climber may reciprocally advance the ascenders to ascend a rope.

In many situations, rope climbers desire increased climbing speed and safety. For example, for professional climbers such as arborists and emergency rescue personnel, rope climbing is a task that may be performed many times on a daily or otherwise frequent basis. Under those circumstances, it may be desirable to decrease the effort required in rope climbing, and to increase the speed and safety of an ascent, potentially saving lives, time and effort over the long-term. Ascenders generally offer such gains, but current climbing systems suffer from several disadvantages that have not been addressed to date.

For example, many known systems include the use a foot ascender. A "foot ascender" commonly refers to an ascender device attached or integrated into the footwear of the climber. Thus, the use of foot ascenders results in one climber's foot—typically the dominate foot—being adjacent to the position of the ascender as the rope is climbed. The leg to which the foot ascender is attached is contracted to move the ascender along the rope, and then the leg is extended causing the foot ascender to lock in place, receiving the weight of the climber ascending the line. Two foot ascenders may be used, but is considered impractical, however, in that any two ascenders on a single static line are not able to be advanced past each other without disengaging one of them from the line, resulting in a relatively unnatural gait. Therefore, several climbing systems have been developed to overcome this disadvantage in an effort to separate the ascenders on the line a distance that will allow for a greater range of movement.

One such example of a known climbing system is described by Spraggon in United States Publication No. 2013/0133981 A1. Spraggon describes the use of an ascender separated from a handle by a connection of a length such that, in use, the ascender is attached to a single rope suspended from above with a second, handled ascender below it. Both ascenders may include foot attachments depending therefrom into which the climber inserts a foot. The ascenders may each then be advanced along the rope in a reciprocating fashion wherein the climber pushes each ascender upwardly while shifting the climber's weight to the foot attachment corresponding to the opposite ascender. The climbing system described by Spraggon and other similar setups incorporating two hand ascenders, however, require that at least one, or both ascenders be attached to the rope at or above the climber's head or chest assembly, which poses significant safety problems to the climber. Furthermore, these systems require the climber to engage his or her hands with the handled ascenders during an ascent, fully occupying the hands.

Other known systems may combine a foot ascender with a handled ascender associated with a foot attachment depending therefrom, but do not overcome the safety issues presented by use on a rope above safety harness assembly tie-in point. The use of one hand and one foot ascender also generally does not provide for a completely hands-free experience, which is considered safer and more desirable. Furthermore, these and other types of unbalanced systems are a serious health concern in that their repetitive use leads to maladies such as hip dysplasia.

Current known systems that attempt to address these issues commonly utilize a foot ascender in combination with a knee ascender. A "knee ascender" refers generally to a device that includes an ascender with a foot attachment (e.g., a loop of rope) depending therefrom at such a length that, when a climber has both legs extended, the ascender portion of the knee ascender device is located at a position on the rope that is approximately level with the knee area of the opposing leg (wherein the foot ascender on that opposing leg remains at boot level). The distance from the foot to the knee approximates a comfortable distance such that the ascenders may be reciprocally advanced, thereby enabling a climber to "walk" up a rope. Knee ascenders typically must include a means for advancing or "tending" the device on the rope in the direction of travel, because there are no handled ascenders by which the climber may use his or her hand to manually advance the ascender.

There are several variations on the use of knee and foot ascender combination climbing systems known in the art. Some systems connect the ascender portion of the knee ascender device to the safety harness attachment point that is typically level with the chest area of the climber by way of an elastic connection. The elastic connection is entirely external to the rest of the knee ascender assembly. When the leg associated with the knee ascender is fully extended and weight-loaded, the elastic connection is under tension. The climber shifts advances the foot ascender along the line by raising the leg associated with the foot ascender, and then shifts his or her weight to that leg. The leg associated with the knee ascender is then raised, and the elastic connection contracts, thereby self-tending the knee ascender along up the rope. These systems, however, do not provide a climber with a full range of motion with regard to his or her legs, because the relatively short distance between the knee area and the chest area results in a tending force that is insufficient to fully advance the knee ascender.

Other systems have been developed to overcome this disadvantage, but none have been able to provide a climber with the use of the legs' full range of motion in a safe and desirable manner. Some climbers extend the length of the elastic connection by extending the connection up and around their neck and shoulders and connecting the end to the harness. This method presents seriously dangerous problems that can be fatal during a fall, and furthermore present an uncomfortable setup that may at the very least chafe and rub against the climbers' shoulders and neck area. Some known systems make use of a bulky pulley system that is integrated into the safety harness to loop the elastic connection around the chest assembly and back down to a lower connection point. These types of systems are bulky, add significant weight to climbing gear, and present multiple lengths of rope, line or cords that get in the way while climbing. Furthermore, they can be much more difficult to don prior to climbing or remove once the destination has been reached, causing significant time delays and safety concerns for regular professional climbers.

It is very desirable from a safety perspective for the loads experienced by climbing ropes to, under routine operation, not meet or exceed safety limits recommended by the manufacture. In the context of elastic cords for which repetitive elongation is expected, the desired length of elongation should be achieved under operating loads that are in a range that will not lead to unwanted or unsafe consequences, such as inelastic elongation, yield and the like. For elastic cords under such linear-elastic range loads, a greater overall length will permit a proportionally greater extension length, according to Hooke's Law. However currently known methods of increasing the expected elongation length of the elastic connection in knee ascenders (and hence the total travel available for the legs) are either grossly unsafe, or the solution results in many exposed lengths of elastic connection that can be cumbersome and unsafe.

It is therefore an unmet need in the prior art for a rope climbing device that provides a climber with the use of his or her full range of leg motion in connection with two ascenders, is compliant with all applicable safety standards, does not present chronic or long-term health issues such as hip dysplasia, is lightweight, allows a climber free use of both hands during ascent, has a minimal number of components that may impede free movement or catch on tools, branches, etc., and that decreases the effort required to climb while increasing productivity measures without presenting immediate health and safe risks. No known references, taken alone or in combination, are seen as teaching or suggesting the presently claimed apparatus for use in rope climbing.

BRIEF SUMMARY OF THE INVENTION

Exemplary embodiments of the present disclosure pertain to devices, apparatuses and assemblies for use in rope climbing. An objective of the present invention is to provide an knee ascender apparatus having an elastic cord with a fixed end and a free end defining a length and a load bearing member having a hollow core open at an aperture, wherein the fixed end of the elastic cord is secured relative to the load bearing member, an interior portion of the length of the elastic cord extends from the fixed end through the hollow core to the aperture, and an exterior portion of the length of the elastic cord extends through the aperture to the free end external to the load bearing member. Exemplary embodiments are further provided with an ascender secured to the load bearing member adjacent to the aperture, and a foot attachment depending from the load bearing member.

A further object of the invention is to provide a knee ascender with a liner secured within the hollow core, thereby defining a cavity having an interior diameter and through which the interior portion of the elastic cord extends, the liner comprising an upper end and a lower end wherein the upper end is positioned in the aperture of the load bearing member. Some embodiments are provided wherein the liner is flexible and the cavity is incompressible.

In some embodiments the fixed end of the elastic cord may form a knot sized larger than the interior diameter of the liner, and be positioned outside of the cavity at the lower end of the liner, thereby securing the fixed end relative to the load bearing member at the lower end of the liner.

It is an object of the invention to, in some exemplary embodiments, wherein the aperture further comprises an unloaded diameter when the load bearing member is not loaded, and a loaded diameter when the load bearing member is loaded, the loaded diameter being less than the unloaded diameter due to stretching caused by a tensile load, to provide the knee ascender with a means for maintaining the unloaded diameter of the aperture when the load bearing member is loaded. In some embodiments, the means for maintaining the unloaded diameter of the aperture when the load bearing member is loaded is provided as a rigid end cap having an opening and fixed to the upper end of the liner and positioned within the aperture.

It is another object of the invention to provide a means for attaching the free end of the elastic cord to a harness. In some embodiments, the means for attaching the free end of the elastic cord to a harness is a boat snap tied to the free end of the elastic cord.

In other embodiments, the load bearing member is provided as a hollow braided rope, or a 12-strand hollow braided polyester weight bearing rope. Some embodiments are provided such that the load bearing member and the foot attachment are formed of a continuous braided rope.

It is an object of this invention to provide a knee ascender of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
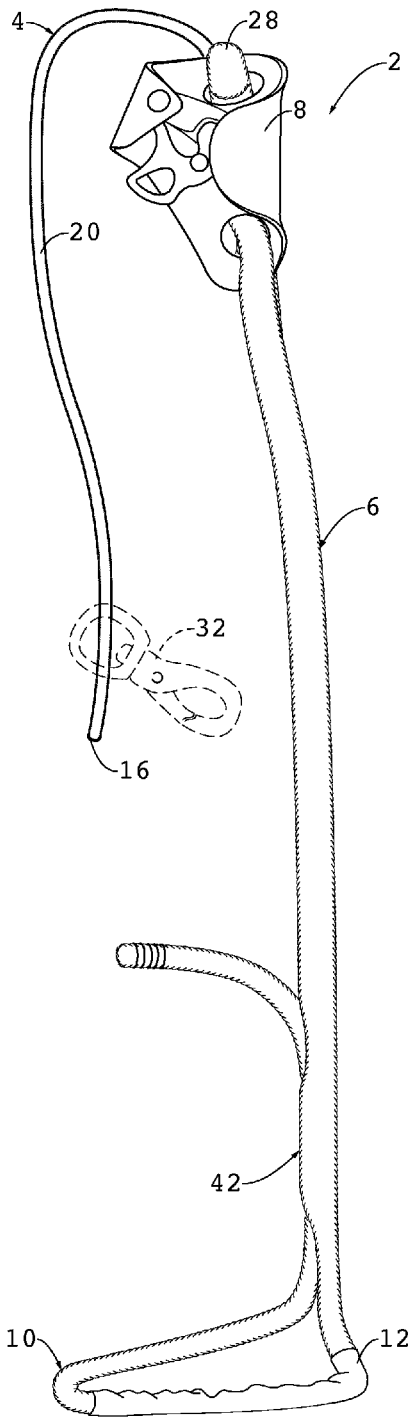
FIG. 1 is a front view of a first embodiment of the secondary foot ascender.
Figure 2:
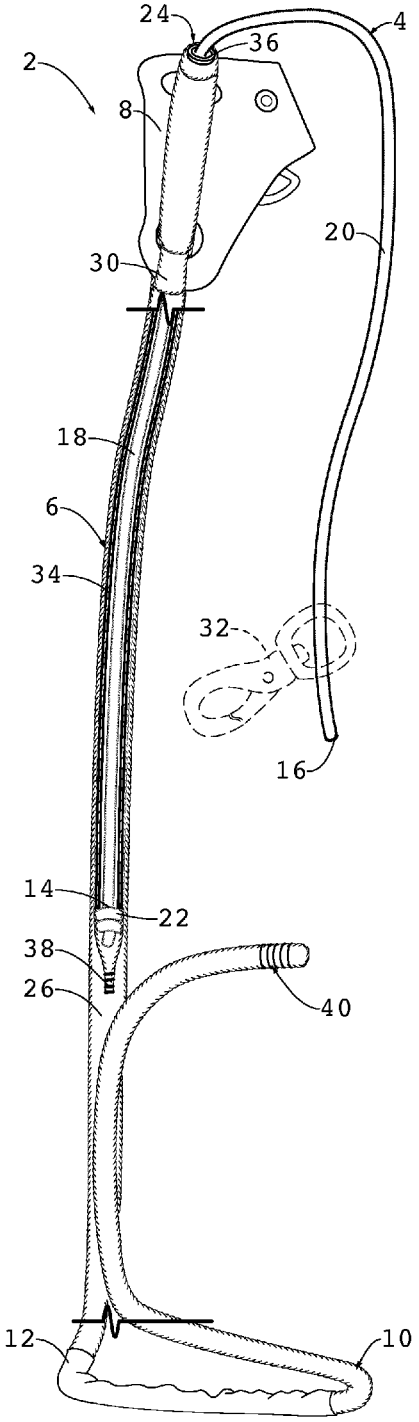
FIG. 2 is a rear, partial sectional view of the embodiment shown in FIG. 1.

Referring to FIGS. 1 and 2, opposing views of an exemplary embodiment of the invention are depicted. FIG. 2 further includes a partial sectional view taken between the broken indicator lines. This exemplary embodiment of the invented knee ascender apparatus 2 illustrates the principles of the invention, and as will be understood by those skilled in the art, the invention may be practiced in other combinations, forms and variations according to the disclosure herein without departing from the scope of the invention.

The knee ascender 2 includes generally an elastic cord 4, a load bearing member 6, an ascender 8, and a foot attachment 10. The foot attachment 10 is depicted in this embodiment of the invented knee ascender 2 as an adjustable loop of rope. An optional protective sleeve 12 may also be positioned around the portion of the foot loop rope in this case to protect the rope from soiling, abrasion and other such negative occurrences. The foot attachment 10 connects the knee ascender 2 to the foot of the user, preferably opposite a foot ascender (e.g., see FIGS. 3 and 4). Any comparable or equivalent means or method of attachment may be utilized without departing from the scope of the invention, as the primary function of the foot attachment is to receive the weight of the climber during ascent and transfer it through the load bearing member and ascender to the static line.

The load bearing member 6 is generally a body of material that will sufficiently bear the weight of the climber and his or her gear safely during a climb and will transfer that weight from the foot attachment to the ascender supported by the static line being climbed. The load bearing member 6 will generally span a distance between the foot attachment 10 and the ascender 8, separating them roughly by the average distance from the foot to the knee. The embodiment shown in connection with FIGS. 1 and 2 has been found to apply to nearly the entire range of climber body types through the manufacture of two sizes: a large size that spaces the ascender 20 inches from the climber's boot, and a small size that spaces the ascender 17 inches from the boot. It should be understood that the distance between the foot attachment and the ascender is not considered limiting, as any desirable distance may be applied without departing from the scope of the invention.

It should also be noted that, in preferred embodiments, the foot attachment 10 and the load bearing member 6 may be formed of a continuous material for simplicity and cost savings. As will be described in further detail below, the preferred embodiment employs a 12-strand hollow braided polyester weight bearing climbing rope. However, it is sufficient for the purposes of this disclosure for those practicing and using the invention that the load bearing member be capable of bearing the desirable loads being exerted thereon, and that the foot attachment provide an attachment point for the climber's foot at a sufficient distance from the ascender.

The load bearing member 6 is a hollow structure, as illustrated in the section portion of FIG. 2. The load bearing member 6 is hollow in order to allow for the elastic cord 4 to be encased therein, providing for an unobtrusive, safe increase in the length of the elastic cord over the prior art systems. The elastic cord 4 has a fixed end 14 and a free end 16 defining a length therebetween. The length of the elastic cord can be viewed generally as being the sum of two portions: an interior portion 18 and an exterior portion 20. The interior portion 18 is encased generally within the body of the device and the exterior portion 20 is external to the body. It is intended for the elastic cord 4 to stretch under normal operating loads, and therefore the division of its length into these two portions 18, 20 is not necessarily constant. However, some part of the elastic cord 4 is always encased within the body of the invention during normal use as will be described in more detail below. This feature is considered to be a significant improvement over the prior art because it allows for a greater length of elastic cord to be used to self-tend the device without creating dangerous circumstances for the climber. Note also that references to cord, rope and line herein should be taken as interchangeable terms unless otherwise specifically stated herein, and are not meant to be limiting.

The interior portion 18 of the elastic cord 4 is contained within a load bearing member 6 of the knee ascender 2. The load bearing member 6 is the component that, when the weight of the climber and his or her encumbrances are shifted to the foot attachment 10, transfers the load to the ascender 8 supported on the static line. The fixed end 14 of the elastic cord 4 is fixed in position with respect to the load bearing member 6, and may be fixed in any desirable position on or in the load bearing member 6 so as to achieve the total elastic cord length needed. In one exemplary embodiment, the fixed end 14 of the elastic cord 4 is configured as a knot 22, thereby securing the fixed end 14 relative to load bearing member 6 at a position just above the foot attachment 10. It should be understood that the position shown should not be considered limiting, and that other positions are considered comparable for the purposes of this disclosure, so long as an interior portion of the elastic cord is contained within the load bearing member. For example, the fixed end of the elastic cord could protrude from the load bearing member at any position along its length, and be knotted, tied, clamped or other such like method used to secure its position.

An aperture 24 in the load bearing member 6 is provided through which the elastic cord 4 may transition from inside of the knee ascender body to the exterior. For the purposes of this disclosure, the aperture 24 delineates the interior 18 and exterior 20 portions of the overall length of the elastic cord 4. In other words, the aperture 24 provides an opening to the hollow core (e.g., 26) of the load bearing member. As mentioned, the fixed end 14 of the elastic cord 4 is secured relative to the load bearing member 6. The interior portion 18 of the length of the elastic cord 4 extends from the fixed end 14 through the hollow core of the load bearing member 6 to the aperture 24. The exterior portion 20 of the length of the elastic cord 4 extends through the aperture 24 to the free end 16 of the elastic cord 4 external to the load bearing member 6.

The ascender 8 is secured to the load bearing member 6 adjacent to the aperture 24. In a preferred embodiment, in which the load bearing member 6 is a made of a hollow braided rope, the ascender 8 may be spliced into the braided rope near and adjacent to the aperture 24 to sufficiently secure it thereto. For example, loops 28 and 30 depict upper and lower splice loops, respectively, coupling the ascender 8 to the load bearing member 6.

The free end 16 of the elastic cord 4 is attached to an attachment point on a climber's harness during use. The free end 16 may be tied directly onto such an attachment point for example, or a quick connection-type device may be tied, stitched or otherwise coupled to the free end 16 so as to provide a means for attaching the free end of the elastic cord to a harness. A preferred embodiment includes the use of a boat snap device 32 tied thereto for quick connection of the invented knee ascender 2 to the safety harness assembly chosen by the user.

One optional means of affixing the fixed end 14 relative to the load bearing member 6 is considered a preferred means because it provides strength and rigidity to the load bearing member 6 while also protecting the elastic cord 4 from friction damage. In that case, a liner 34 may be secured within the hollow core 26 of the load bearing member 6. The liner 34 defines a cavity having an interior diameter and has an upper end and a lower end. The interior portion 18 of the elastic cord 4 extends through the cavity. The liner 34 is secured within the load bearing member 6 such that its upper end is positioned at or in the aperture 24. The cavity is aligned with the aperture such that the elastic cord passes therefrom to exit the liner 34 and the load bearing member 6. A knot 22 formed outside of the cavity at the lower end may be used secure the fixed end 14 of the elastic cord 4 relative to the load bearing member 6 if the knot 22 is sized larger that the interior diameter of the cavity. It is also preferred but optional that the liner 34 be formed of a flexible material with reference to unbalanced forces along and perpendicular to its axis (i.e., bowable), but material that is also relatively incompressible in cross section and longitudinally so as to prevent pinching and general impedance of the elastic cord 4 during use. Relative incompressibility in the longitudinal direction is considered desirable where the fixed end of the elastic cord is positioned at the lower end of the liner, in order for the tending forces exerted on the liner to be fully transmitted to advance the ascender up the static line. It is known, for example, that polyester braided weight bearing rope elongates under load and shrinks in diameter. The liner 34 is preferred as a means of preventing such compressive forces from reaching the elastic cord 4, which would prevent smooth self-tending of the knee ascender 2.

Additionally, where hollow braided rope is used to construct the load bearing member 6, the aperture 24 may have the tendency to shrink in diameter in the same manner when the load bearing member 6 experiences a load. This is preferable in that, for embodiments utilizing a liner, the cross sectional shrinkage will operate to secure the liner within the rope when the knee ascender is under tension. That is, the aperture 24 will have an unloaded diameter, or aperture size, when the load bearing member 6 or knee ascender 2 generally are not loaded with weight. It will have a second, smaller loaded diameter when the load bearing member 6 and knee ascender 2 generally are loaded with weight. To avoid pinching at the aperture 24 due to the tensile load applied to the load bearing member 6, and further to avoid rope-on-rope friction damage as the elastic cord 4 extends and retracts during use, an optional but preferable means for maintaining the unloaded diameter of the aperture 24 when the load bearing member 6 is loaded may be included as well. One preferable means consists of the use of an end cap 36 formed of a rigid, low-friction material having an opening. The end cap 36 is affixed to the upper end of the liner and positioned within the aperture. The opening of the end cap 36, the aperture, 24 and the cavity of the liner 34 are aligned to allow free extension and retraction of the elastic cord 4. In some embodiments, the end cap 36 may be formed of a material similar to that of the liner 34, and may be formed as a unitary piece with the liner itself, or may be affixed by a strong adhesive applied between the liner 34 and the end cap 36, for instance.

In preferred embodiments, the load bearing member 6 and the foot attachment 10 are formed of a single, continuous length of braided rope. In one embodiment, the continuous length of rope begins at a first end 38 and ends at a second end 40. Each end 38 and 40 may be knotted and melted or otherwise safely terminated. The liner 34 is inserted with the knotted 22 fixed end 14 of the elastic cord 4 to the first end 38 of the continuous braided rope. The upper end of the liner 34 and the end cap 36 are positioned at an aperture 24 formed in the wall of the rope and it is spliced into the ascender 8 as the rope is doubled back down upon itself. After enclosing the first end 38 of the rope, the foot attachment 10 is formed by forming an adjustable foot loop and splicing the tail of the rope just before the second end 40 thereof at 42.

Figure 3:
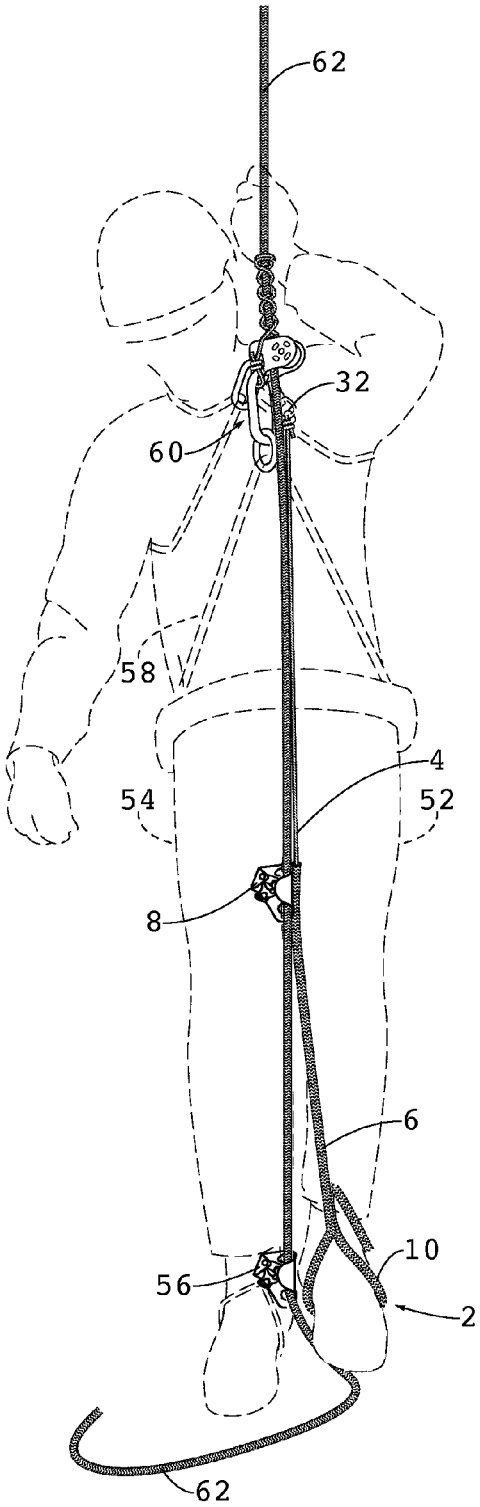
FIG. 3 is a perspective view thereof in an extended state when combined with an exemplary rope climbing setup.
Figure 4:
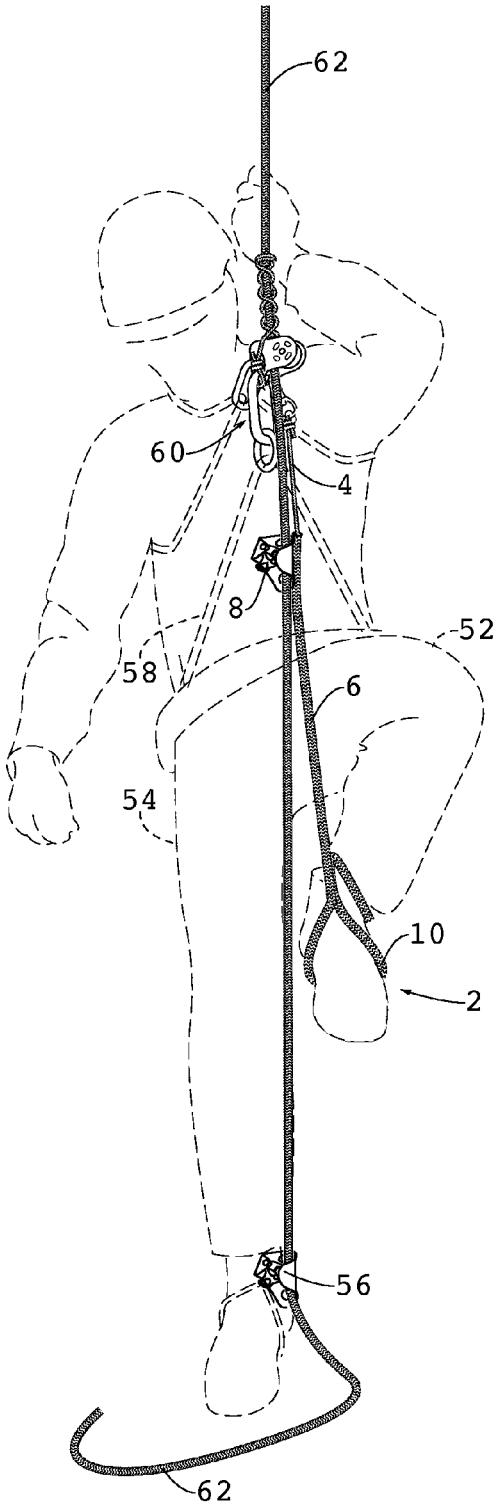
FIG. 4 is a retracted state thereof.

Turning to FIGS. 3 and 4, two states of use of an exemplary embodiment of the invention are depicted in perspective views. In the first, the climber 50 generally has both the left 52 and right 54 legs extended. An exemplary embodiment of the invented knee ascender 2 as described in connection with FIGS. 1 and 2 is in place on the left leg 52 and a common boot ascender 56 is in place on the right leg 54. A safety harness 58 with a chest hitch assembly 60 is worn by the climber 50. The free end of the elastic cord 4 is attached to the chest hitch assembly 60 with a boat snap 32 tied thereto. The static line 62 depends from above and down through the chest hitch assembly 60, the ascender 8 component of the knee ascender 2, and the boot (foot) ascender 56. The two ascenders 8 and 56 are spaced apart about the distance from the foot to the knee, as previously discussed, creating ample distance between the ascenders, thus resulting in full freedom of leg movement for the climber 50.

Note that there are many climbing harness configurations in use today, and that the harness 58 and hitch assembly 60 shown merely depict an illustrative version. Various life support systems, harnesses, hitch assemblies, etc. may be used in connection with the invention disclosed herein without departing from the scope, making the invented knee ascender quite versatile.

FIG. 3 illustrates a fully extended state of the knee ascender 2, in which the elastic cord 4 is shown fully extended. The greatest portion of its length exists in this state as the exterior portion, positioned external to the load bearing member 6. From the extended state of the knee ascender 2, the climber 50 may lift his or her left leg 52 to the position shown in FIG. 4. The elastic cord 4 has contracted as the climber's weight was shifted to the right leg 54, drawing the fixed end encased within the load bearing member 6 at the lower end of the liner upward toward the chest assembly 60. The liner and load bearing member 6 have transferred the compressive force to advance the ascender 8 up the rope 62. The climber 50 may now shift his or her weight back to the left leg 52, which will begin to straighten as the right leg 54 is drawn up toward the climber's body, similarly advancing the boot ascender 56 up the rope 62. In this manner, the invention may be used to "walk" up a rope with speed, decreased effort, and increased comfort while remaining safe and unencumbered by burdensome gear and bulky equipment.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An apparatus for use in rope climbing comprising:

an elastic cord having a fixed end and a free end defining a length;

a load bearing member having a hollow core open at an aperture, wherein the fixed end of the elastic cord is secured relative to the load bearing member, an interior portion of the length of the elastic cord extends from the fixed end through the hollow core to the aperture, and an exterior portion of the length of the elastic cord extends through the aperture to the free end external to the load bearing member;

an ascender secured to the load bearing member adjacent to the aperture; and a foot attachment depending from the load bearing member.

2. The apparatus of claim 1, further comprising a liner secured within the hollow core, thereby defining a cavity having an interior diameter and through which the interior portion of the elastic cord extends, the liner comprising an upper end and a lower end wherein the upper end is positioned in the aperture of the load bearing member.

3. The apparatus of claim 2, wherein the fixed end of the elastic cord comprises a knot sized larger than the interior diameter of the liner and positioned outside of the cavity at the lower end of the liner, thereby securing the fixed end relative to the load bearing member at the lower end of the liner.

4. The apparatus of claim 2, wherein the liner is flexible and the cavity is incompressible.

5. The apparatus of claim 2, wherein the aperture further comprises an unloaded diameter when the load bearing member is not loaded, and a loaded diameter when the load bearing member is loaded, the loaded diameter being less than the unloaded diameter due to stretching caused by a tensile load, the apparatus further comprising a means for maintaining the unloaded diameter of the aperture when the load bearing member is loaded.

6. The apparatus of claim 5, wherein the means for maintaining the unloaded diameter of the aperture when the load bearing member is loaded comprises a rigid end cap having an opening and fixed to the upper end of the liner and positioned within the aperture.

7. The apparatus of claim 1, further comprising a means for attaching the free end of the elastic cord to a harness.

8. The apparatus of claim 7, wherein the means for attaching the free end of the elastic cord to a harness comprises a boat snap tied to the free end of the elastic cord.

9. The apparatus of claim 1, wherein the load bearing member comprises a hollow braided rope.

10. The apparatus of claim 1, wherein the load bearing member comprises a 12-strand hollow braided polyester weight bearing rope.

11. The apparatus of claim 1, wherein the load bearing member and the foot attachment are formed of a continuous braided rope.

12. An apparatus for use in rope climbing comprising:

an elastic cord having a fixed end and a free end defining a length;

a liner comprising an upper end and a lower end and defining a cavity having an interior diameter, wherein the fixed end of the elastic cord is secured at the lower end of the liner, an interior portion of the length of the elastic cord extends from the fixed end through the liner to the upper end, and an exterior portion of the length of the elastic cord extends through the upper end to the free end external to the liner;

a load bearing member having an aperture and encasing the liner such that the upper end of the liner is positioned in the aperture;

an ascender secured to the load bearing member adjacent to the aperture; and a foot attachment depending from the load bearing member.

13. The apparatus of claim 12, wherein the fixed end of the elastic cord comprises a knot sized larger than the interior diameter of the liner and positioned outside of the cavity at the lower end of the liner.

14. The apparatus of claim 12, wherein the liner is flexible and the cavity is incompressible.

15. The apparatus of claim 12, wherein the aperture further comprises an unloaded diameter when the load bearing member is not loaded, and a loaded diameter when the load bearing member is loaded, the loaded diameter being less than the unloaded diameter due to stretching caused by a tensile load, the apparatus further comprising a means for maintaining the unloaded diameter of the aperture when the load bearing member is loaded.

16. The apparatus of claim 15, wherein the means for maintaining the unloaded diameter of the aperture when the load bearing member is loaded comprises a rigid end cap having an opening and fixed to the upper end of the liner and positioned within the aperture whereby the opening, aperture and cavity are aligned.

17. The apparatus of claim 12, further comprising a means for attaching the free end of the elastic cord to a harness.

18. The apparatus of claim 17, wherein the means for attaching the free end of the elastic cord to a harness comprises a boat snap tied to the free end of the elastic cord.

19. The apparatus of claim 12, wherein the load bearing member and the foot attachment are formed of a continuous braided rope.

20. The apparatus of claim 19, wherein the continuous braided rope comprises a 12-strand hollow braided polyester weight bearing rope.

* * * * *